US008578685B2

(12) United States Patent
Fitzgerald, IV

(10) Patent No.: US 8,578,685 B2
(45) Date of Patent: Nov. 12, 2013

(54) APPARATUS FOR FORMING AND FILLING A FLEXIBLE PACKAGE

(75) Inventor: Matthew Louis Fitzgerald, IV, Tomhannock, NY (US)

(73) Assignee: Momentive Performance Materials Inc., Waterford, NY (US)

( * ) Notice: Subject to any disclaimer, the term of this patent is extended or adjusted under 35 U.S.C. 154(b) by 689 days.

(21) Appl. No.: 12/361,887

(22) Filed: Jan. 29, 2009

(65) Prior Publication Data

US 2010/0139219 A1 Jun. 10, 2010

Related U.S. Application Data

(60) Provisional application No. 61/120,167, filed on Dec. 5, 2008.

(51) Int. Cl.

| | |
|---|---|
| ***B65B 31/04*** | (2006.01) |
| ***B65B 3/02*** | (2006.01) |
| ***B65B 9/08*** | (2012.01) |

(52) U.S. Cl.

USPC ..... 53/511; 53/547; 53/562; 53/284.7

(58) Field of Classification Search

CPC ..... B65B 9/093; B65B 9/087; B65B 9/08; B65B 3/02

USPC ..... 53/511, 512, 547, 562, 284.7, 374.3, 53/374.5, 374.6, 375.3

See application file for complete search history.

(56) References Cited

U.S. PATENT DOCUMENTS

| | | | | |
|---|---|---|---|---|
| 2,649,671 | A * | 8/1953 | Bartelt | 53/511 |
| 3,114,298 | A | 12/1963 | Boone | |
| RE26,553 | E * | 3/1969 | Nutting et al. | 53/562 |
| 3,553,934 | A * | 1/1971 | Johnson et al. | 53/562 |
| 3,700,388 | A * | 10/1972 | Johnson et al. | 53/562 |
| 3,886,030 | A * | 5/1975 | Hurst | 156/504 |
| 3,975,888 | A | 8/1976 | Jones | |
| 4,201,031 | A * | 5/1980 | Wiles | 53/562 |
| 4,216,639 | A | 8/1980 | Gautier | |
| 4,252,052 | A | 2/1981 | Meyers et al. | |
| 4,454,979 | A | 6/1984 | Ikeda et al. | |
| 5,181,365 | A | 1/1993 | Garvey et al. | |
| 5,353,573 | A * | 10/1994 | Durrant | 53/562 |
| 5,400,565 | A * | 3/1995 | Terminella et al. | 53/133.4 |
| RE35,067 | E | 10/1995 | Bauknecht | |
| 5,524,418 | A | 6/1996 | Thompson | |
| 5,564,252 | A * | 10/1996 | Adelmann | 53/562 |
| 5,699,653 | A | 12/1997 | Hartman | |
| 6,195,967 | B1 | 3/2001 | Todd et al. | |
| 6,381,919 | B2 | 5/2002 | Todd et al. | |
| 6,393,809 | B2 | 5/2002 | Todd et al. | |
| 6,834,474 | B2 | 12/2004 | Dutra et al. | |
| 6,921,594 | B2 | 7/2005 | Huang et al. | |

(Continued)

*Primary Examiner* — Stephen F Gerrity

(74) *Attorney, Agent, or Firm* — Philip D. Freedman; Philip D. Freedman PC; Joseph E. Waters

(57) ABSTRACT

An apparatus for forming and filling a flexible package, comprises: a film unwind station for unwinding a web of flexible film from a roll of film includes: a folding station for folding the web into a pair of opposing walls; a strip unwind station for unwinding a strip of semi-rigid material from a roll of material and positioning the strip between the pair of opposing walls of the web; a metal buffer plate insertable between the strip and one of the opposing walls of the web; sealing stations, separating stations and filling stations.

5 Claims, 6 Drawing Sheets

(56) References Cited

U.S. PATENT DOCUMENTS

| | | | | |
|---|---|---|---|---|
| 6,976,946 | B2 | 12/2005 | Wied et al. | |
| 7,581,765 | B2 | 9/2009 | Minford | |
| 2001/0008064 | A1* | 7/2001 | Todd et al. | 53/374.6 |
| 2005/0224373 | A1* | 10/2005 | Bailey et al. | 206/219 |
| 2008/0313998 | A1 | 12/2008 | Ligon | |
| 2009/0304875 | A1* | 12/2009 | Zerfas et al. | 426/122 |

* cited by examiner

APPARATUS FOR FORMING AND FILLING A FLEXIBLE PACKAGE

This application claims the benefit of provisional application 61/120,167 filed Dec. 5, 2008.

BACKGROUND OF THE INVENTION

The invention relates to a method and apparatus for forming and filling a flexible package in which a continuous web of material is converted into a plurality of individual pouches. The continuous web of material is folded in half over a plow to form two continuous side panels joined by a bottom fold. The folded web is passed through a series of seal bars that form transverse seals between side panels, thereby forming a strip of pouches interconnected by transverse seals. Either before or after filling, a cutter cuts through each transverse seal to form individual pouches with unsealed top edges. The pouches are transferred to a pouch filler, filled with product, and sealed. The sealed pouches are then collected for transport. Apparatus of this type may be categorized as horizontal or vertical machines, depending on the general direction of web travel.

Copending applications assigned to Momentive Performance Materials disclose a flexible package that comprises a semi-rigid flat that cradles a pouch. The semi-rigid pouch, can be folded or rolled to compress the cradled pouch to express a content through the expressing shaped closure end. There is a need for an on-line method and apparatus to form and fill pouches for these types of flexible packages.

BRIEF DESCRIPTION OF THE INVENTION

The invention provides an on-line method and apparatus to form and fill a flexible package that comprises a semi-rigid flat that cradles a pouch. The semi-rigid pouch can be folded or rolled to compress the cradled pouch to express a content through an expressing shaped closure end.

In an embodiment, a method of forming and filling a flexible package comprises: directing a web of film and a semi-rigid strip in a machine direction; folding the web of film to have a pair of opposing walls with the semi-rigid strip between the walls; attaching the strip to one of the opposing walls; sealing the opposing walls of the web of film together at spaced sealing regions to form pouches between the sealing regions; removing a section of the sealing regions at a lower portion to provide multiple pouches connected at an upper portion; separating the connected pouches from the web of film to provide an individual pouch; filling an interior section of the individual pouch through an opening in the upper portion of the pouch with a flowable material; forming a top sealed region closing the opening in the pouch; and removing a portion of the top sealed region.

In another embodiment, the invention is a method of forming and filling a squeezable package, comprising: directing a web of flexible film and a semi-rigid strip in a machine direction; folding the web of film to have a pair of opposing walls having a front wall and a back wall and positioning the strip between the front and back wall; inserting a metal buffer plate between one of the front wall and the back wall and the strip; sealing the strip to the other of the front wall and the back wall and restricting scaling to the one of the front wall and the back wall using the metal buffer plate; forming a lower non-linear side seal between the opposing walls in the web of flexible film; forming an upper non-linear side seal between the opposing walls in the web of flexible film partially coextensive with the lower side seal; removing a first non-linear section in a lower portion of the web of film to provide multiple pouches connected at an upper portion thereof; separating the connected pouches from the web of film at the upper portion to provide an individual pouch; filling an interior section of the individual pouch through an opening in the upper portion of the pouch with a flowable material; forming a top seal to close the opening; and removing a second non-linear section in the upper portion of the pouch to form the squeezable package having a narrower upper portion than lower portion.

In yet another embodiment, the invention is an apparatus for forming and filling a flexible package, the apparatus comprising: a film unwind station for unwinding a web of flexible film from a roll of film; a folding station for folding the web into a pair of opposing walls; a strip unwind station for unwinding a strip of semi-rigid material from a roll of material and positioning the strip between the pair of opposing walls of the web; a metal buffer plate insertable between the strip and one of the opposing walls of the web; a first sealing station having a sealing bar for forming a seal between the strip and the other of the opposing walls; a second sealing station having a pair of sealing bars positioned to form a lower non-linear side seal between the opposing walls of the web of flexible film at spaced intervals; a third sealing station having a pair of sealing bars positioned to form an upper non-linear side seal between the opposing walls of the web of flexible film at spaced intervals to define connected pouches between adjacent lower and upper side seals; a first cutting station provided to remove a portion of the lower side seal and a portion of the upper side seal, while the remainder of the side seals remain uncut and connected at an upper portion of the pouches; a separating station having a knife positioned to separate the connected pouches into separate individual pouches; a filling station having a reciprocally moveable filling tube insertable into the individual pouches through an opening in the pouch for filling the pouch with a flowable material; a fourth sealing station having a pair of sealing bars positioned to form a top seal in the pouch to close the opening; and a second cutting station provided to remove a portion of the top seal.

And in another embodiment, the invention is a pouch machine for forming pouches from a web of laminate material folded to have mating first and second sides, the web advancing along a web path, the machine comprising: a first pair of drive rolls positioned to engage opposite sides of the web and to draw the web through the apparatus, a variable speed motor drivingly connected to the drive rolls and selectively operable in a continuous and intermittent modes, a continuous mode drawing the web in a continuous manner, and an intermittent mode drawing the web in stepped increments related to pouch width; a second pair of drive rolls positioned to engage opposite sides of a semi-rigid material strip and to draw the semi-rigid material strip through the apparatus parallel to the drawn web, a variable speed motor drivingly connected to the drive rolls and selectively operable in a continuous and intermittent modes, a continuous mode drawing the strip in a continuous manner, and an intermittent mode drawing the strip in stepped increments related to pouch width; a biasing form to fold the web into opposite sides, with an edge of at least one of the opposite sides sealed to the semi-rigid material strip between edges of both opposite sides; a sealer having at least one pair of opposed seal bars positioned on opposite sides of the web path, each seal bar mounted for translation in a direction parallel to the web path, a variable speed motor drivingly connected and selectively operable to translate each seal bar in the parallel direction in timed synchronism with the web passing between the seal bars, the seal bars also being mounted for translation in a direction perpendicular to the web path, a variable speed motor drivingly connected and selectively operable to actuate the seal bars in the perpendicular direction to engage or disengage the web in timed synchronism with web travel; and a cutter having opposed cutting surfaces disposed on opposite sides of the web path, a variable speed motor drivingly connected to the cutter and selectively operable to cut the web in registration with seals formed by the sealer.

DETAILED DESCRIPTION OF THE INVENTION

The term "sealant" as used herein includes an entire variety of caulks including silicones, latex and acrylic caulk; filler compounds; adhesive or mastic-type materials, such as stucco, concrete and cementious-material patching and crack filling compounds; gasketing compounds; gutter, flashing, skylight, or fish tank seam or sealant compounds; butyl or rubber sealants, cements and caulk; roof cements; panel and construction adhesives; glazing compounds and caulks; gutter and lap sealants; silica gel-based firebrick, masonry and ceramic crack fillers and cements; silicone-based glues; ethylene glycol-containing latex glazing compounds; and the like.

One preferred sealant is an organopolysiloxane room temperature vulcanizable (RTV) composition. The room temperature vulcanizable silicone elastomer composition can contain a silanol stopped base polymer or elastomer, reinforcing and/or extending filler, cross-linking silane and cure catalyst. These RTV compositions are prepared by mixing diorganopolysiloxanes having reactive end groups with organosilicon compounds that possess at least three hydrolyzably reactive moieties per molecule. The known RTV compositions are widely used as elastic sealing materials for applications involving the gaps between various joints such as: gaps between the joints of structures; joints between structural bodies and building materials in buildings; gaps between a bathtub and wall or floor; cracks on tiles in bathrooms; gaps in the bathroom such as those around the washbasin and those between a washbasin supporting board and a wall; gaps around a kitchen sink and the vicinity; spacings between panels in automobiles, railroad vehicles, airplanes and ships; gaps between prefabricated panels in various electric appliances, machines; and the like. Room temperature vulcanizable silicone sealants thus may be utilized in a wide variety of caulking and sealing applications.

Features of the invention will become apparent from the drawings and following detailed discussion, which by way of example without limitation describe preferred embodiments of the invention.

Figure 1:
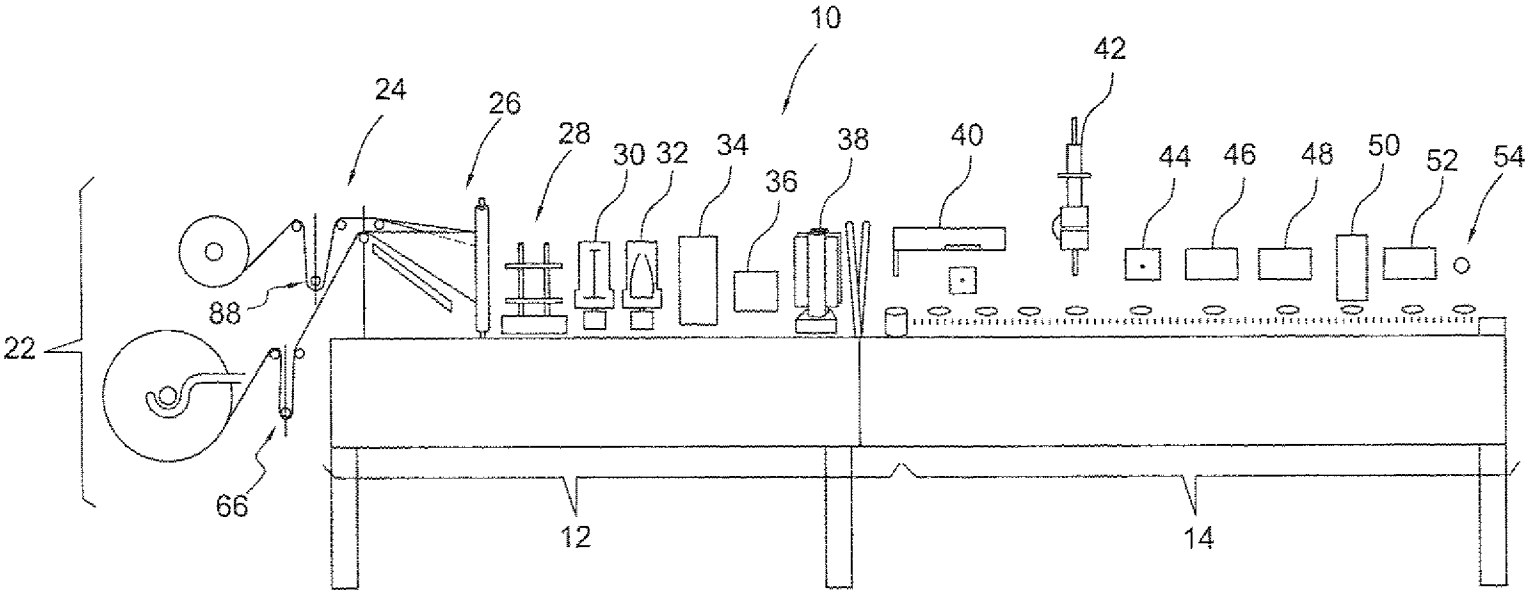
FIG. 1 is a schematic elevation of an apparatus for forming and filling a flexible package.

FIG. 1 is a schematic representation of a preferred embodiment of the invention showing modules of an apparatus 10 for forming and filling a flexible package. The apparatus 10 includes a forming stage 12 and a filling/final stage 14. FIG. 1 shows an in feed module (or unwind station) 22 that directs a web laminate film 56 and a semi-rigid materials strip 76 in a machine processing direction, to a first pouch forming or folding stage 24; a gusset-forming station 26 that folds the web laminate film 56 to the semi-rigid strip 76 so that the semi-rigid strip 76 is between a pair of opposing film walls, as hereinafter described in detail; a rocker arm tacking station 28 that attaches the strip 76 to one of the pair of opposing walls.

Further apparatus 10 includes seating station 30 with first sealing bar and sealing station 32 that sequentially seal opposing walls of the web of film 56 together at spaced sealing regions to form a pouch between, the sealed regions. While the FIG. 1 shows two sealing stations 30, 32, the stations 30, 32 can represent any number of stations. For example in one embodiment, the sealing stations 30, 32 comprise a first sealing station having a sealing bar for forming a seal between the strip 76 and the other of the opposing walls, a second sealing station having a pair of sealing bars positioned to form a lower non-linear side seal between the opposing walls of the web of flexible film 56 at spaced intervals; and a third sealing station having a pair of sealing bars positioned to form an upper non-linear side seal between the opposing walls of the web of flexible film 56 at spaced intervals to define connected pouches between adjacent side seals.

Further, the apparatus 10 includes first cooling station 34 and bottom die cutter 36 to form a pouch blank 110. The bottom die cutter 36 can remove a portion of the lower side seal and a portion of the upper side seal, while the remainder of the side seals remain uncut and connected at an upper portion of the pouches. Feed rollers 38 feed the pouch blank 110 to filling/final stage 14.

Further, filling/final stage 14 includes inflating station 40 where the pouch is blown open, fill station 42 to fill the pouch with product, deairing station 44 that removes air from the filled pouch, first top seal station 46 that applies a first seal, second top seal station 48 that applies a second seal, second cooling station 50 to cool the pouch and a second cutting station-lop die cutter station 52 to cut top blank material from the pouch in the top seal area. FIG. 1 shows two sealing stations 46, 48. However, these stations 46, 48 can represent any number of sealing stations. For example in one embodiment, the sealing stations 46, 48 comprise a first sealing station having a sealing bar for forming a seal between the strip 76 and the other of the opposing walls, a second sealing station having a pair of sealing bars positioned to form a lower non-linear side seal between the opposing walls of the web of flexible film 56 at spaced intervals; and a third sealing station having a pair of sealing bars positioned to form an upper non-linear side seal between the opposing walls of the web of flexible film 56 at spaced intervals to define connected pouches between adjacent lower and upper side seals.

At station 52, a pouch for forming a package, can be formed with narrowed neck and adjacent closed opening with taper toward an opening. Pick off area is shown as 54. A formed pouch can be removed from apparatus 10 at pick off area 10 and applied to a backing.

Figure 3:
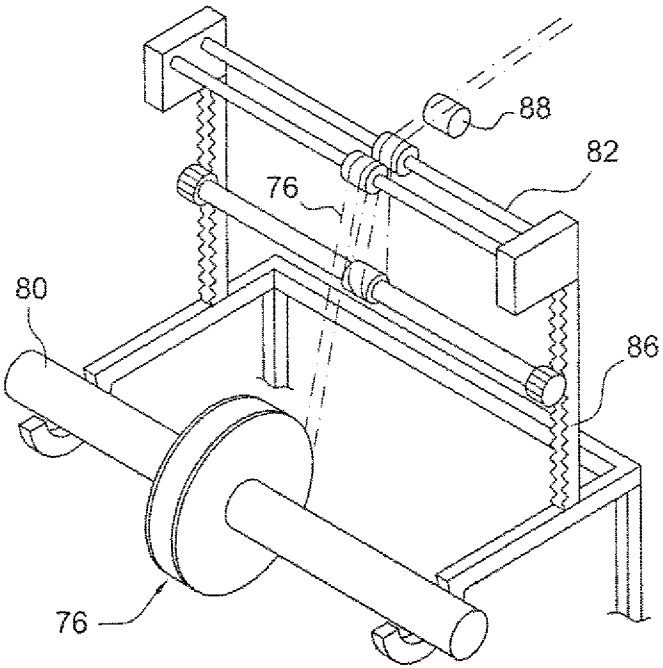
FIGS. 2 to 6A to 6C, are schematic views of stages or stations of the apparatus of FIG. 1.
Figure 2:
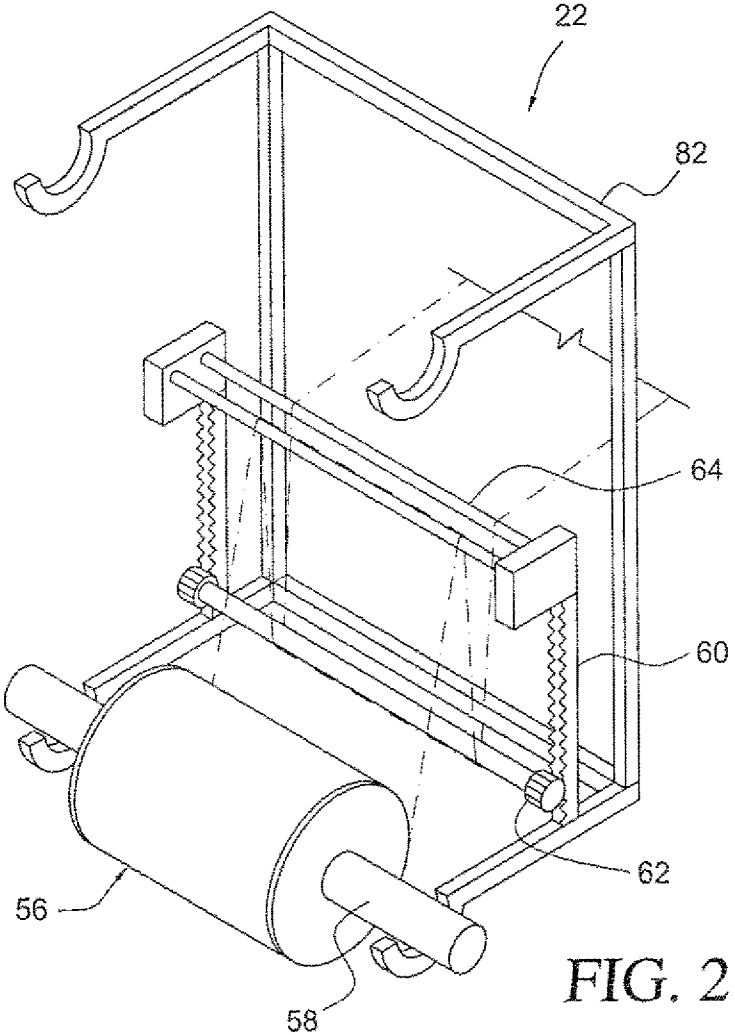

The apparatus 10 produces pouches from a continuous web of material. FIG. 2 and FIG. 3 show sections of infeed module 22 of the apparatus 10. Referring to FIG. 1 and FIG. 2, a roll of web laminate 56 is rotatably connected by means of reel 58. The reel 58 is driven by the same motor (not shown) as the drive of reel 80 (hereinafter described) to apply the same tension to laminate 56 as to the semi-rigid material 76. The web 56 is fed from reel 58 via rack 60 that includes pinion 62 that is controlled by idler shaft 64 to apply a constant tension to rollers 66 and 88 (FIG. 1). The web 56 is threaded over the tension rollers 66 to first pouch forming stage 24 (FIG. 1) that includes plow assembly 68 (FIG. 5A) for folding the web to form pouch side panels joined at a common bottom edge.

In FIG. 3, shown is a spool of semi-rigid material strip 76. In one embodiment, the semi-rigid material strip 76 can be a high density polyethylene or preferably, a coextrusion of metallocene and high density polyethylene. The semi-rigid material strip 76 is fed as a strip from reel 80 over idler 82 via rack and pinion assembly 86 via constant tension rollers 88 to first pouch forming stage 24 (FIG. 1). The reel 80 may be driven by an unwind motor (not shown) for driving the semi-rigid material strip 76 with web 56. In an embodiment, the rack and pinion 86 is fitted with a bottom relatively weak spring and the top of the rack and pinion 86 is pre loaded to bring idler 82 to an effective range.

Figure 4B:
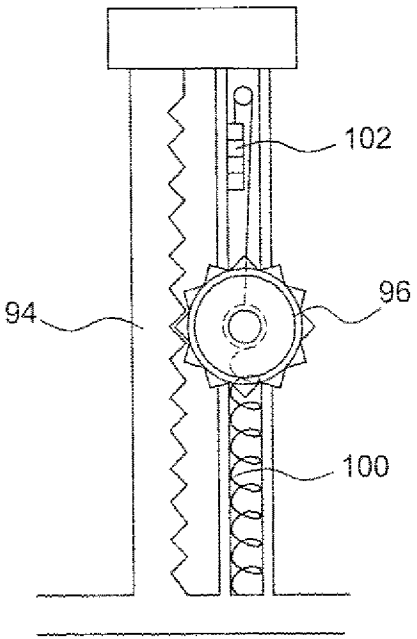
Figure 4A:
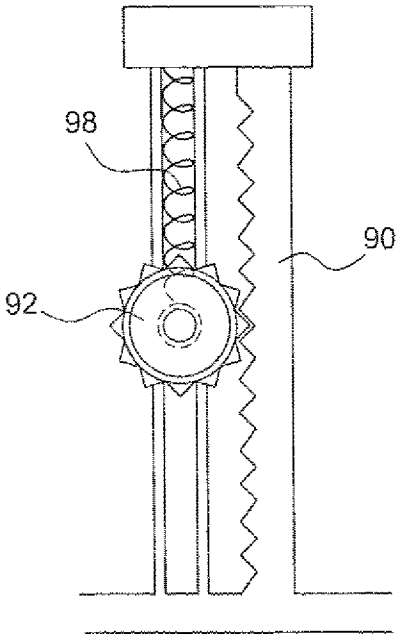

FIG. 4A shows a rack 90 pinion 92 to feed web laminate 56 and FIG. 4B shows a rack 94 and pinion 96 to feed semi-rigid material strip 76. Rack 90 and pinion 92 include downward biasing spring 98. The spring 98 loaded rack 94 bobs up and to down so that the feed rollers 38 impart an intermittent tension under periodic transient feed motion to web 56. Pinion 96 includes bottom ¾ biasing spring 100 (weak spring) that follows the periodic feed motion imparted to web 56. The pinion 96 is preloaded at the top with weights 102. The spring 100 and weights 102 combination biases the rack away from the material strip 76 to avoid a harsh backpresssured tug on the feeding material strip 76.

Gusset-forming station 26 folds the web of film 56 to the semi-rigid strip 76 so that the semi-rigid strip is between a pair of opposing film walls; rocker arm tacking station 28 attaches the strip 76 to one of the pair of opposing film walls; sealing stations 30 and 32 sequentially seal opposing walls of the web of film together at spaced sealing regions to form pouches between the sealed regions; first cooling station 34 and bottom die cutter 36 form a gusseted pouch blank. Feed roller 38 feeds the gusseted pouch blank to filling/final stage 14. Filling/final stage 14 includes inflating station 40 where a pouch is blown open, fill station 42 to fill the pouch with product, deairing station 44 that removes air from the filled pouch, first top seal station 46 that applies a first seal, second top seal station 48, second cooling station 50 to cool the pouch, top die cutter station 52 to cut top blank material from the pouch to form a narrowed neck adjacent a first closure end of the pouch blank 110 and pick off area 54.

Figure 5B:
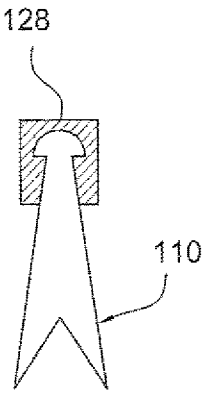
Figure 5A:
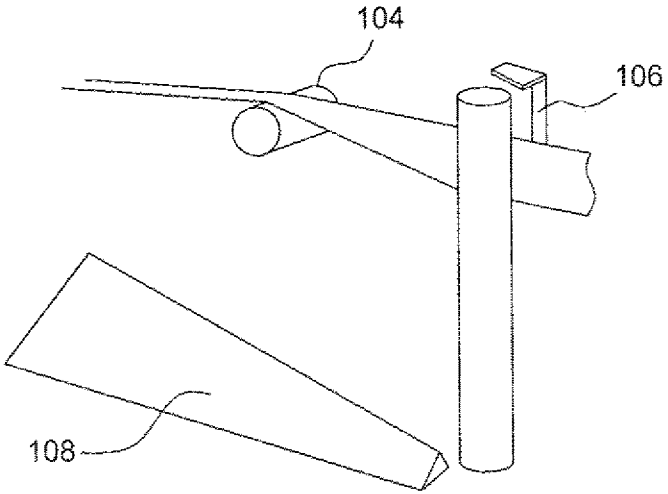

FIG. 5A shows functioning of gusset forming station 26 including HDPE idler 104, vertical crease bars 106 and gusset-forming plow 68. Web laminate 56 is oriented to the vertical so that imprinting on the web laminate 56 is to the top vertical. The strip 76 is twisted from horizontal feed to a vertical feed. The laminate 56 is then folded bottom to top against the strip 76 to form a pouch blank 110. The plow 68 then forms a W-shaped laminate bottom edge by supporting the pouch blank 110 at upper lines on either pouch blank side and imposing into a middle line between the lower supported lines to form a gusset shape or roughly W-shaped cross section. Then, the supported W-shape is creased through vertical crease bars 106 to form blank 110 shown in FIG. 5B.

Figure 6B:
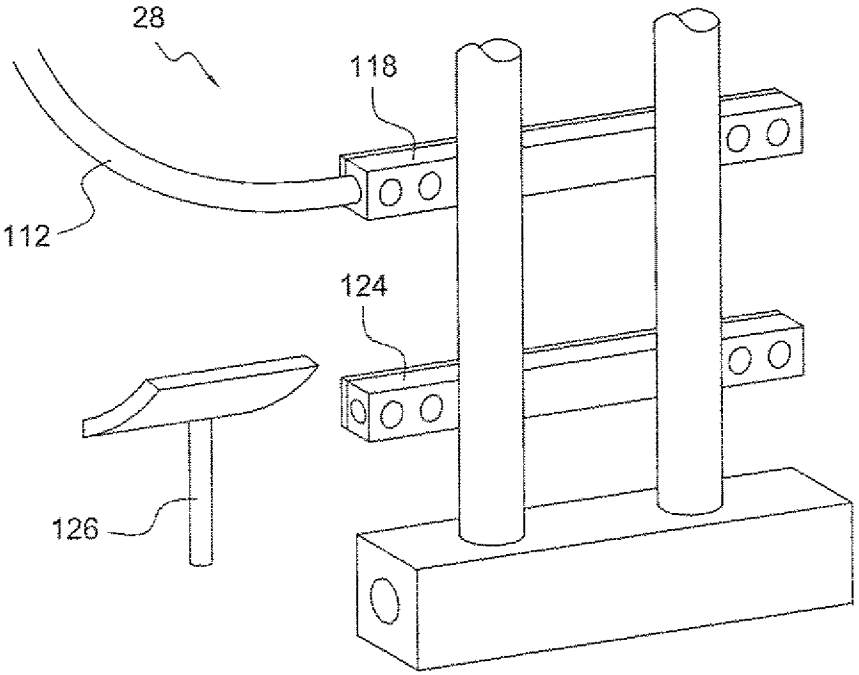
Figure 6C:
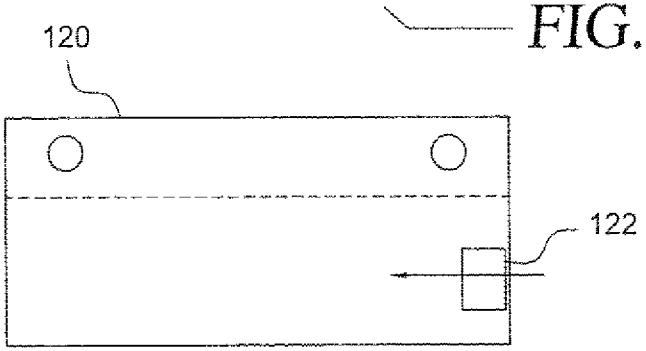
Figure 6A:
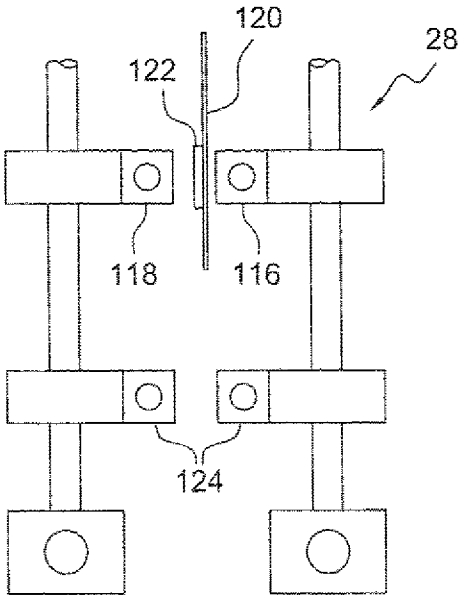

The FIG. 5B blank 110 next is conveyed to rocker arm tacking station 28 as shown in FIG. 6A and FIG. 6B. FIG. 6A is a side elevation view of the station 28 and FIG. 6B is a side view racing an advancing pouch blank 110. In FIG. 6A and FIG. 6B, the station 28 includes upper heated bar 116, upper cool bar 118 and guide bar 120 with recess 122. The guide bar recess 122 holds the blank semi-rigid strip 76 that forms blank 110 (FIG. 5B) for back side tacking to web laminate 56. The tacking station 28 includes lower gusset seal bars that seal a lower gusseted end of the blank 110. Cool air from cooling tube 112 (FIG. 6B) blows on an inner side of the upper cool bar 118 to maintain one side of the cool bar 118 at a lower temperature than the approximate 319° F. heated side of the heated bar 116. The 319° F. heated side of upper sealing bars 116 tacks the strip 76 to the web laminate 56 at one side. The temperature differential between bars 116, 118 prevents the seal from entirely closing the blank so that the blank can be filled with product at a later station. Guide 120 supports web 56 in the form of the blank 110 as the web 56 is advanced through the tacking station 28. Guide 126 prevents web laminate 56 from sagging. FIG. 6C is a schematic representation of guide 120.

The blank 110 next advances through a sealing section of the apparatus 10 in which a number of pouch forming operations take place. FIG. 1 shows sealing section 30 and sealing section 31. The two sealing sections divide side seal tasks into two separate operations. This overcomes any problem with variation in the strip 76 location, which otherwise could result in an improper sealing of the web laminate 56 to the strip 76.

Referring again to FIG. 1, at cooling station 34, 40° C. water flows through sides of a cooling tool to properly cool blank 110 to allow shearing of web laminate 56. Blank 110 is shaped at bottom die cutter 36. The pouch blank 110 is inflated at inflation station 40 and filled with product at fill station 42. Here, vacuum suction cups can be applied to an outer surface of opposing walls of the pouch 110 to hold the pouch open while filling. Air is removed from the pouch blank 110 at deairing station 44. The blank 110 is top sealed at first top seal station 46 and second top seal station 48 and cooled at second cooling station 50. The hatched material 128 shown in FIG. 5B is removed from the blank 110 at top die cutter station 52.

Referring again to FIG. 1, a succession of flexible packages is formed and filled by infeeding a web laminate 56 and semi-rigid material strip 76 in parallel to a first pouch forming stage 24. The web 56 is folded at first pouch forming stage 24 into a pair of opposing walls with the semi-rigid strip 76 held in between ends of the folded web 56 walls. The semi-rigid strip 76 is attached to one of the formed opposing walls. A gusset can be formed in the folded web 56 bottom at gusset-forming station 26. Then the opposing walls of the web of film 56 are sealed together at spaced sealing regions at sealing stations 30 and 32 to form pouches between the sealed regions. At top die cutter station 52, a section of the sealing regions is removed at a lower portion to provide multiple pouches connected at an upper portion. Then, the pouches can be separated from the folded web of film 56 to provide an individual pouch. An interior section of the individual pouch can be filled with a flowable material through an opening in the upper portion of the pouch. Or conversely, the pouches can first be filled and then separated to provide the individual filled pouches. A top sealed region is formed at first top seal station 46 and second top seal station 48 to close the opening in the pouch where the pouch was filled. A portion of the top sealed region can then be removed at top die cutter station 52 to form a plurality of final filled flexible packages.

The apparatus 10 provides a method for forming and filling a flexible package using an in-line process. The method comprises directing a web of film 56 and a semi-rigid strip 76 in a machine direction. At gusset forming station 26, the web of film 56 is folded to provide a pair of opposing front and back walls with the semi-rigid strip 76 therebetween. A metal buffer plate such as guide 120, is inserted between one of the front wall or the back wall and the strip.

At rocker arm tacking station 28, the strip 76 is attached to one of the opposing walls and opposing walls of the web of film 56 are sealed together at spaced sealing regions to form pouches between the sealing regions. A section of the sealing regions at a lower portion is removed at bottom die cutter 36, to provide multiple pouches connected at an upper portion.

The connected pouches are separated from the web of film 56 to provide an individual pouch. At fill station 42, an interior section of an individual pouch is filled with a flowable material through an opening in the upper portion of the pouch. At sealing stations 48 and 50, a top sealed region is formed, closing the opening in the pouch. A portion of the top sealed region is removed at die cutter station 52 to form a top tip section of the pouch. A pouch can be removed from the apparatus 10 at pick off station area 54.

In an embodiment, apparatus 10 can be used to produce a strip of multiple pouches. In this embodiment, a portion of sealed regions at a lower portion can be removed to provide multiple pouches connected by at an upper portion. The connected pouches can be separated at connecting web 56 to provide individual pouches. Interiors of the individual pouches can be filled with flowable material through an opening in an upper portion of the pouch. Then, a top sealed region of the pouch can be closed and excess material removed from the top region by a die cutter to form a shaped spout area tapering toward the top sealed opening with a portion of the semi-rigid material strip adjacent the sealed opening to reinforce the opening.

Figure 7:
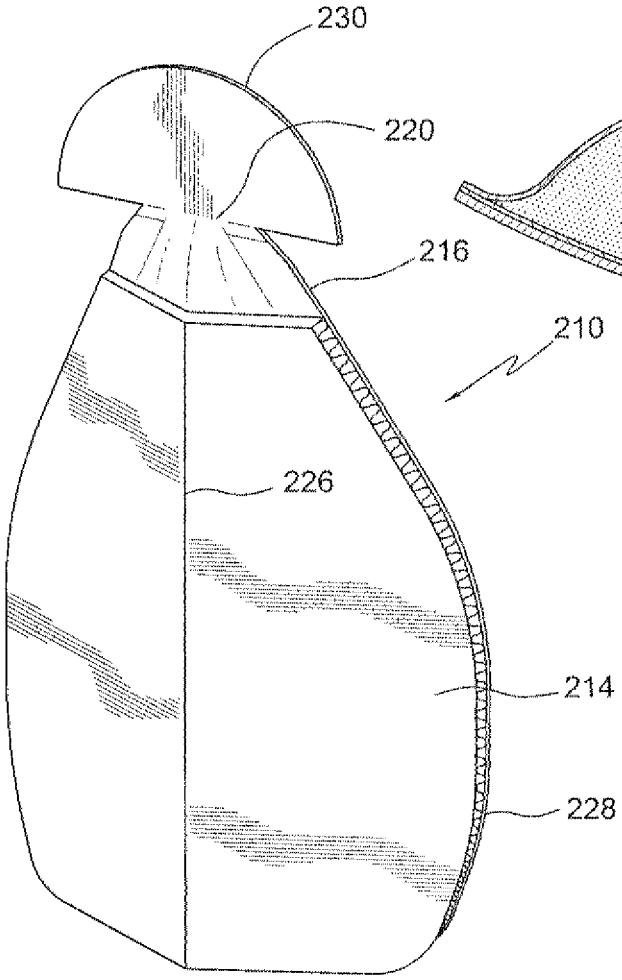
FIGS. 7 to 8 are schematic perspective views of a package, front and back.
Figure 9:
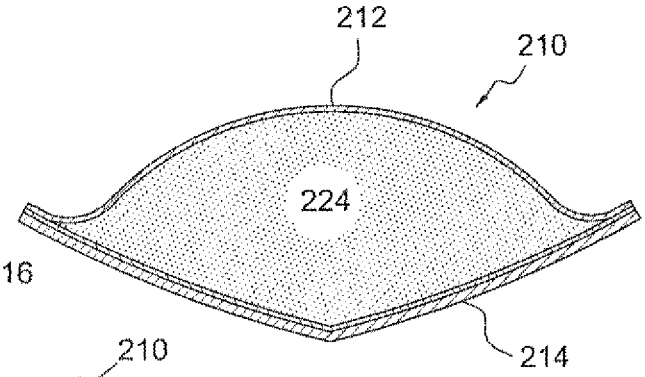
FIG. 9 is a cut-away view through A-A of the FIG. 8 package.
Figure 8:
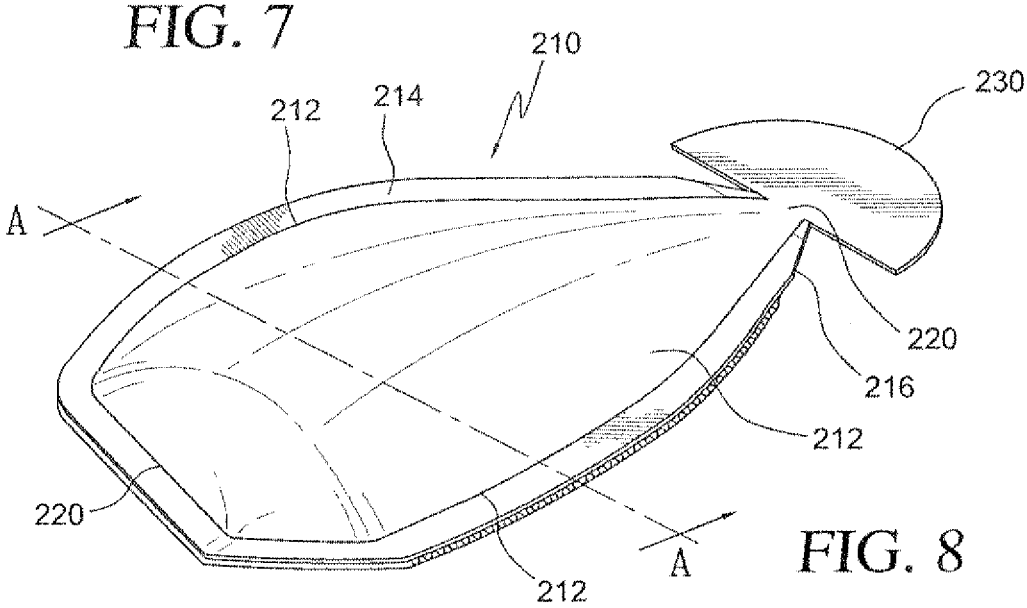

In an embodiment, a pouch produced by apparatus 10, can be applied to a flat or card and filled with a sealant such as a caulk, to form a package, for example, a flexible package according to FIGS. 7, 8 and 9. In this application, a "pouch" is a bag or container to hold material. A "package" is a packet or container bundle that may include a pouch. FIGS. 7 and 8 are schematic perspective views of a flexible package, front and back and FIG. 9 is a cut-away view through A-A of the FIGS. 7 and 8 flexible package. The figures show the flexible package 210 comprising a pouch 212 supported by a foldable flat 214. The size of fillable flexible package 210 can vary, but in some embodiments can be about 20±5 cm by 15±3 cm or smaller.

The fillable flexible package 210 comprises a pouch 212 of plastic or foil film formed from web laminate 56 in the forming method described above. The pouch 212 further includes flat 214 comprising a more rigid or thicker material than the pouch 212 film and a spout-forming area 216 on the rigid flat 214 side of the fillable flexible package 210. The area 216 comprises a shaped semi-rigid material of intermediate thickness and rigidity between that of the material of the film 212 and the material of the pouch 214. The rigidity can be imparted from the section of semirigid strip 76 that is used in the forming process to tack web laminate 56. The strip 76 section is located at area 216 within the interior of the pouch 212 (not shown). In the embodiment shown in the figures, area 216 is trapezoidal-shaped with slanted sides from the rigid material sidewall toward the package tip end 220 that forms a tapered nozzle when folded or rolled with the rigid flat 214. In forming the package 210, the flat or "back card" 214, can be folded and attached to the back card 214 to bow the semi-rigid material 76 behind shaped area 216 to define an arcuate outlet adjacent an opening at the first closure end 220.

The fillable package 210 further includes a semicircular-shaped tear tab 230 to facilitate opening at the tip 220. The top film 212 can be pleated 228 to allow for an increased volume of a sealant 224 and the bottom end 222 can comprise a gusset to accommodate an increased amount of fill material.

The pouch 212 can be heat-sealed or otherwise cradled to the flat 214 as shown in FIG. 9. A first closure end of pouch 212 forms an expressing shape tip 220. In FIGS. 7 and 9, the more rigid flat 214 has crease 226 that can be a fold or score running along the longitudinal axis of the more rigid flat 214 from tip 220 to a second closure end 222. The crease 226 is marked into the flat 214 surface to facilitate longitudinal folding of the fillable flexible package 210. The crease 226 can be a pressed, folded, wrinkled, embossed line or score. The crease 226 can run generally longitudinal to a long axis of the fillable flexible package 210 from one end of the fillable flexible package 210 toward the tip end 220.

The crease 226 promotes longitudinal folding of opposite rigid flat sections against the pouch 222 to compress the pouch 212 to express sealant 224 from the pouch 212 interior. The more rigid flat 214 comprises a rigid or conformable surface that is configured to form cradling compression surfaces against pouch 212 when folded by a force applied to rigid flat 214 opposite sections. The more rigid flat 214 can be a flat comprising any material that is more inflexible or rigid than the pouch 212 material. An area 216 (from semi-rigid material strip 76) along a top interior portion of pouch 212 at area 216, comprises a shaped strip of intermediate thickness and rigidity between the material of the pouch 222 and the material of the flat 214.

Materials suitable for pouch 212 include single layer, co-extruded or laminated film or foil. Preferably the material has a permeability rating of 1 or lower. Suitable film materials include a plastic film, such as low-density polyethylene or other thermoplastic or foil film material such as polypropylene, polystyrene or polyethylene-terephthalate. The foil is a thin, flexible leaf or sheet of metal such as aluminum foil for example. In one embodiment, the film is a polyethylene and bioriented polypropylene coextruded film. An aluminum foil is a preferred pouch 12 film material. Suitable foil can be derived from aluminium prepared in thin sheets with a thickness less than 0.2 mm/0.008 in, although much thinner gauges down to 0.006 mm can be used. A suitable foil can comprise a laminate with other materials such as a plastic or paper.

The pouch 212 material can be impermeable or only slightly permeable to water vapor and oxygen to assure content viability. For example, the film can have a moisture vapor transport rate (MVTR, ASTM D3833) of less than 10 g/day/$m^2$. In an embodiment, the MVTR of the film is less than 5 g/day/$m^2$ and preferably less than 1 g/day/$m^2$ and most preferably of less than 0.5 g/day/$m^2$. The pouch 212 film can be of various thicknesses. The film thickness can be between 10 and 150 μm, preferably between 15 and 120 μm, more preferably between 20 and 100 μm, even more preferably between 25 and 80 μm and most preferably between 30 and 40 μm. In an embodiment, the pouch 212 comprises a biaxle oriented nylon (print layer), adhesive and a PET layer adhered to a liner low density polyethylene film.

While preferred embodiments of the invention have been described, the present invention is capable of variation and modification and therefore should not be limited to the precise details of the Examples. The invention includes changes and alterations that fall within the purview of the following claims.

What is claimed is:

1. A pouch machine for forming pouches from a web of laminate material folded to have mating first and second sides, the web advancing along a web path, the machine comprising:

at least one variable speed roller positioned to engage the web and to draw the web through the apparatus, the at least one roller selectively operable in a continuous mode and in an intermittent mode, the continuous mode drawing the web in a continuous manner, and the intermittent mode drawing the web in stepped increments related to pouch width;

a second at least one variable speed roller positioned to engage a semi-rigid material strip and to draw the semi-rigid material strip through the apparatus parallel to the drawn web, the second at least one roller selectively operable in a continuous mode and intermittent mode, separately but in-step with the mode of the first at least one roller, the continuous mode drawing the web strip in a continuous manner, and the intermittent mode drawing the web strip in stepped increments related to pouch width;

a biasing form comprising a plow that imposes into the web to fold the web into opposite sides, with an edge of at least one of the opposite sides aligned for sealing to the semi-rigid material strip between edges of both opposite sides;

a sealer having at least one pair of opposed seal bars positioned on opposite sides of the web path, each seal bar mounted for translation in a direction parallel to the web path in timed synchronism with the web passing between the seal bars;

a biased spring loaded rack and pinion mechanism that feeds advancing web laminate material in an intermittent mode and a rack and pinion mechanism to advance the semi-rigid material strip in an intermittent advancement synchronized with the intermittent advancement of the web laminate and seal bar; and a cutter having opposed cutting surfaces disposed on opposite sides of the web path, a variable speed motor drivingly connected to the cutter and selectively operable to out the web in registration with seals formed by the sealer.

2. The pouch machine of claim 1, further comprising a pouch filling station to receive and fill individual pouches from the cutter.

3. The pouch machine of claim 1, further including a cooling station for cooling the seals after the sealer.

4. The pouch machine of claim 2, further including a gas flush for flushing an interior section of the pouch prior to filling or with filling.

5. The pouch machine of claim 2, wherein the filling station includes a pair of vacuum suction cups for separating the opening in the pouch before filling.

* * * * *